US009979089B2

(12) United States Patent
Koskiniemi et al.

(10) Patent No.: US 9,979,089 B2
(45) Date of Patent: May 22, 2018

(54) DUAL POLARIZED ANTENNA APPARATUS AND METHODS

(71) Applicant: Pulse Finland Oy, Oulunsalo (FI)

(72) Inventors: Kimmo Koskiniemi, Oulu (FI); Petteri Annamaa, Oulunsalo (FI)

(73) Assignee: PULSE FINLAND OY, Oulunsalo (FI)

( * ) Notice: Subject to any disclaimer, the term of this patent is extended or adjusted under 35 U.S.C. 154(b) by 110 days.

(21) Appl. No.: 15/089,081

(22) Filed: Apr. 1, 2016

(65) Prior Publication Data

US 2017/0288312 A1 Oct. 5, 2017

(51) Int. Cl.

| | |
|---|---|
| ***H01Q 21/26*** | (2006.01) |
| ***H01Q 9/28*** | (2006.01) |
| ***H01Q 1/48*** | (2006.01) |
| ***H01Q 1/24*** | (2006.01) |

(52) U.S. Cl.

CPC ..... *H01Q 9/285* (2013.01); *H01Q 1/243* (2013.01); *H01Q 1/48* (2013.01); *H01Q 21/26* (2013.01)

(58) Field of Classification Search

None

See application file for complete search history.

(56) References Cited

U.S. PATENT DOCUMENTS 7,804,460 B2 * 9/2010 Lee ..... H01Q 9/26 343/797
2005/0253769 A1 * 11/2005 Timofeev ..... H01Q 1/246 343/797
2009/0058752 A1 * 3/2009 Lee ..... H01Q 9/26 343/817
2011/0014800 A1 1/2011 Cheng et al.
2012/0242554 A1 * 9/2012 Gunnels ..... H01Q 9/285 343/816
2013/0229314 A1 9/2013 Kuehler et al.
2014/0232502 A1 8/2014 Gutierrez et al.
2014/0232503 A1 8/2014 Gutierrez
2015/0070234 A1 * 3/2015 Jones ..... H01Q 1/12 343/798
2015/0138032 A1 * 5/2015 Yona ..... H01Q 1/521 343/816
2015/0229025 A1 8/2015 Kalistaja et al.
2015/0375246 A1 12/2015 Kalistaja et al.

* cited by examiner

*Primary Examiner* — Trinh Dinh
(74) *Attorney, Agent, or Firm* — Gazdzinski & Associates, PC

(57) ABSTRACT

Multi-element dual polarized antenna apparatus and methods of utilizing and manufacturing the same. The antenna apparatus includes two planar antenna elements. One antenna element is configured to communicate RF waves characterized by a first polarization and another antenna element is configured to communicate RF waves characterized by second polarization. Feed elements are disposed such that their longitudinal axes are parallel with one another while their transverse axes are disposed perpendicular with one another. Individual feed elements include planar feed structures disposed on sides of the feed elements that are facing the same quadrant. Arranging the antenna feed structure using the above configuration provides for an antenna characterized by improved improved port to port isolation and/or improved cross polarization discrimination without the use of additional components.

20 Claims, 6 Drawing Sheets

DUAL POLARIZED ANTENNA APPARATUS AND METHODS

COPYRIGHT

A portion of the disclosure contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna apparatus for use in electronic devices such as wireless or portable radio devices, and more particularly in one exemplary aspect to a dual polarized antenna apparatus and methods of manufacturing and use.

DESCRIPTION OF RELATED TECHNOLOGY

Antennas in wireless communication networks are critical devices for both transmitting and receiving wireless signals with and without amplification. With the evolution of network communication technology migrating from less to more capable technology; e.g., third generation systems ("3G") to fourth generation systems ("4G") with higher power, the need for antennas which can clearly receive fundamental frequencies or signals with minimal distortion are becoming more critical. Moreover, in so-called multiple feed antenna arrangements there is a need to optimize various performance parameters in order to more effectively handle these more capable technologies.

Accordingly, there is a need for multiple feed antenna arrangements that optimize various performance parameters such as antenna element isolation and cross polarization performance. Specifically, dual polarized antenna systems that improve upon, inter alia, port to port isolation as well as cross polarization discrimination simultaneously are needed.

SUMMARY

The present disclosure satisfies the foregoing needs by providing, inter alia, multiple feed antenna arrangements that optimize various performance parameters and methods of manufacture and use.

In a first aspect, an antenna apparatus is disclosed. In one embodiment, the antenna apparatus includes a dual polarized radio frequency antenna apparatus. In a first variant, the dual polarized radio frequency antenna apparatus includes a first radiator component configured to communicate radio frequency waves of a first polarization; a second radiator component configured to communicate radio frequency waves of a second polarization; a first feed component galvanically coupled to the first radiator component; and a second feed component galvanically coupled to the second radiator component, the first and the second feed components configured to communicate radio frequency waves of the first and the second polarization, respectively. The first feed component comprises a first planar conductor characterized by a longitudinal dimension and a transverse dimension; the second feed component comprises a second planar conductor characterized by a longitudinal dimension and a transverse dimension; the longitudinal dimension of the second feed component being arranged parallel with the longitudinal dimension of the first feed component; the transverse dimension of the second feed component being arranged perpendicular with the transverse dimension of the first feed component; and the first planar conductor and the second planar conductor are configured to face a given quadrant.

In another variant, the first polarization is characterized by a polarization orientation that is 90 degrees from a polarization orientation associated with the second polarization.

In yet another variant, an orientation of the first polarization and an orientation of the second polarization are configured at an angle with respect to one another, the angle selected from the range between 85 and 95 degrees, inclusive.

In yet another variant, the first radiator component is configured at the angle with respect to the second radiator component.

In yet another variant, the first feed component includes a first planar ground conductor; and a first planar dielectric substrate having a first planar surface configured to support the first planar conductor and a second planar surface configured to support the first planar ground conductor; and the second feed component includes a second planar ground conductor; and a second planar dielectric substrate having a third planar surface configured to support the second planar conductor and a fourth planar surface configured to support the second planar ground conductor.

In yet another variant, the first and the second planar ground conductors are configured to be coupled to the first and the second radiator components, respectively.

In yet another variant, the first planar conductor is configured to be coupled to a first port of a radio frequency transceiver; and the second planar conductor is configured to be coupled to a second port of the radio frequency transceiver, the transceiver configured to communicate radio frequency waves of the first polarization and the second polarization waves in a frequency band.

In yet another variant, the frequency band is selected from a range between 1700 MHz and 2700 MHz.

In yet another variant, the communication of the radio frequency waves of the first polarization is configured to occur contemporaneous with communication of the radio frequency waves of the second polarization.

In yet another variant, the communication of the radio frequency waves of the first polarization and communication of the radio frequency waves of the second polarization comprise a plurality of carriers configured using orthogonal frequency division multiplexing.

In yet another variant, the communication of the radio frequency waves of the first polarization is configured to provide a first communication path; and the communication of the radio frequency waves of the second polarization is configured to provide a second communication path, the second communication path characterized by a different path length relative to the first communication path.

In yet another variant, the first and the second communication paths are configured to effectuate polarized multiplexing.

In yet another variant, the first communication path is characterized by a first spatial parameter; and the second communication path is characterized by a second spatial parameter that is different from the first spatial parameter.

In yet another variant, the first communication path is characterized by a first path length; and the second communication path is characterized by a second path length, the second communication path configured to produce a differing signal phase as compared to a phase of signal propagating over the first communications path.

In a second aspect, a component of an antenna is disclosed. In one embodiment, the component of an antenna is configured to communicate radio signals of a first polarization and a second polarization, the component including: a first planar feed structure configured to be coupled to a first radiator of the antenna, the first radiator configured to communicate radio signals of the first polarization; and a second planar feed structure configured to be coupled to a second radiator of the antenna, the second radiator configured to communicate radio signals of the second polarization. The first polarization is configured to be substantially orthogonal with the second polarization; a plane of the first planar feed structure is configured substantially orthogonal to a plane of the second planar feed structure; and the first planar feed structure and the second planar feed structure are disposed such that they both face a given quadrant of a three dimensional space.

In one variant, the first planar feed structure is characterized by a first longitudinal dimension and a first transverse dimension; the second planar feed structure is characterized by a second longitudinal dimension and a second transverse dimension; and the second longitudinal dimension of the second planar feed structure is substantially parallel with the first longitudinal dimension of the first planar feed structure.

In another variant, the second transverse dimension of the second planar feed structure is substantially orthogonal with the first transverse dimension of the first planar feed structure.

In yet another variant, the first planar feed structure includes a first planar dielectric substrate, a first planar ground conductor and a first planar feed conductor, the first planar ground conductor and the first planar feed conductor being disposed on opposing sides of the first planar dielectric substrate; and the second planar feed structure includes a second planar dielectric substrate, a second planar ground conductor and a second planar feed conductor, the second planar feed conductor and the second planar ground conductor being disposed on opposing sides of the second planar dielectric substrate.

In yet another variant, the first planar dielectric substrate and the second planar dielectric substrate are disposed such that a surface of the first planar dielectric substrate that is supporting the first planar feed conductor and a surface of the second planar dielectric substrate that is supporting the second planar feed conductor are facing the given quadrant.

In a third aspect, methods associated with the aforementioned antenna apparatus are disclosed. In one embodiment, a method for configuring an antenna apparatus of a wireless device to communicate radio signals via a polarization diversity scheme includes disposing a plane of a first planar feed conductor perpendicular to a plane of a second planar feed conductor; disposing a longitudinal dimension of the first planar feed conductor parallel with a longitudinal dimension of the second planar feed conductor; disposing the first planar feed conductor and the second planar feed conductor such that they both face a given quadrant of a three dimensional space; coupling the first planar feed conductor to a first radiator component of the antenna apparatus, the first radiator component configured to communicate radio signals of a first polarization; and coupling the second planar feed conductor to a second radiator component of the antenna apparatus, the second radiator component configured to communicate radio signals of a second polarization, the second polarization being different than the first polarization thereby effectuating the polarization diversity scheme.

In a fourth aspect, wireless communications devices that utilize the aforementioned antenna apparatus are disclosed. In one embodiment, the mobile wireless device includes: one or more antenna elements, a main body portion that includes a metalized surface, and a back cover portion that is at least partly capacitively coupled to a device ground of the mobile wireless device.

In one variant, the at least metalized surface is connected to the device ground via one or more galvanic contacts.

In another variant, the back cover portion is at least partly capacitively coupled to the device ground via the metalized surface.

In a fifth aspect, a method of manufacturing the aforementioned antenna apparatus is disclosed.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1:
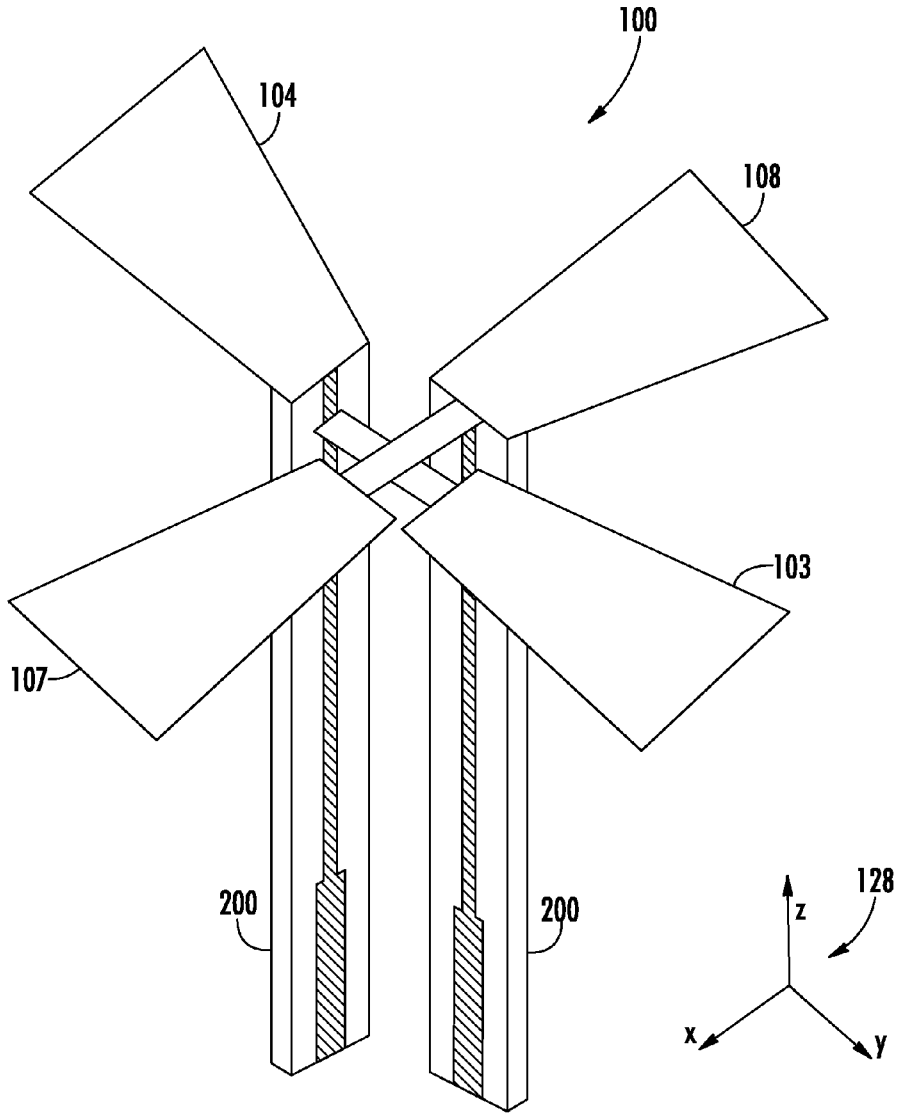
FIG. 1 is an isometric view of one embodiment of a multi-element dual polarized antenna apparatus configured in accordance with the principles of the present disclosure.

All Figures disclosed herein are © Copyright 2014-2016 Pulse Finland Oy. All rights reserved.

DETAILED DESCRIPTION

Reference is now made to the drawings, wherein like numerals refer to like parts throughout.

As used herein, the terms "antenna" and "antenna system" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range" and "frequency band" refer without limitation to any frequency range for communicating signals. Such signals may be communicated pursuant to one or more standards or wireless air interfaces.

Furthermore, as used herein, the term "radiator" refers without limitation to an element that can function as part of a system that receives and/or transmits radio-frequency electromagnetic radiation; e.g., an antenna.

The terms "feed" and "feed conductor" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

It is recognized that the antenna embodiments discussed herein may be readily manufactured using a variety of known methods including, for example: (1) flexible substrates such as that disclosed in co-owned and co-pending U.S. patent application Ser. No. 13/835,129 entitled "Flexible Substrate Inductive Apparatus and Methods" filed Mar. 15, 2013, and co-owned and co-pending U.S. patent application Ser. No. 13/801,967 entitled "Flexible Substrate Inductive Apparatus and Methods" filed Mar. 13, 2013, each of the foregoing being incorporated herein by reference in its entirety; (2) sheet metal fabrication techniques; (3) fluid or vapor deposition; (4) "2-shot" molding; (5) pad printing; (6) print deposition such as that disclosed in co-pending U.S. patent application Ser. No. 13/782,993 entitled "Deposition Antenna Apparatus and Methods" filed Mar. 1, 2013; U.S. patent application Ser. No. 14/620,108 entitled "Methods and Apparatus for Conductive Element Deposition and Formation" filed Feb. 11, 2015; and U.S. patent application Ser. No. 14/736,040 entitled "Methods and Apparatus for Conductive Element Deposition and Formation" filed Jun. 10, 2015, the contents of each of the foregoing incorporated herein by reference in their entireties and/or (7) laser direct structuring (LDS) as applicable such as that disclosed in co-owned and co-pending U.S. patent application Ser. No. 12/482,371 entitled "Miniaturized Connectors and Methods" filed Jun. 10, 2009, which is incorporated herein by reference in its entirety, such techniques and structures being readily determined by those of ordinary skill when given the present disclosure.

Overview

In one salient aspect, the present disclosure provides for a multi-element polarized antenna apparatus and methods of manufacturing and utilizing the same. The antenna apparatus includes, for example, two planar feed elements with each of these feed elements including a feed structure and a ground structure. The feed and ground structures for a given feed element are disposed parallel to one another (e.g., on two sides of a rectangular printed circuit board (PCB) in some implementations). One feed element is configured to communicate radio frequency waves characterized by a first polarization while a second feed element is configured to communicate radio frequency waves characterized by a second polarization. Feed elements are disposed such that their longitudinal axes are parallel with one another and their planes (e.g., the PCB planes) are perpendicular with one another. Port to port isolation (S21) and/or cross polarization discrimination (XPD) between the two elements of the antenna are improved by configuring feeds of the two elements to face a given quadrant. Such a configuration may also be referred to as a "facing feeds configuration". Selected spatial mutual orientation of the antenna feed structures provides for a repeatable manufacturing process, does not necessitate additional parts and/or circuits while also providing for improved antenna performance compared to other prior art antenna configurations.

Detailed Description of Exemplary Embodiments

Detailed descriptions of the various embodiments and variants of the apparatus and methods of the present disclosure are now provided. While primarily discussed in the context of base stations for mobile communication, the various apparatus and methodologies discussed herein are not so limited. In fact, many of the apparatus and methodologies described herein are useful in any number of complex antennas, whether associated with mobile or fixed devices that can benefit from the feed placement methodologies and apparatus described herein.

FIG. 1 illustrates a multi-element dual polarized antenna apparatus 100 configured in accordance with one implementation. The antenna apparatus 100 of FIG. 1 includes two radiator structures, with a first radiator structure consisting of radiator elements 103, 104 and the second radiator structure consisting of radiator elements 107, 108. The radiator structures of the antenna 100 are disposed perpendicular/orthogonal with one another as shown in FIG. 1. In addition, each of these radiator structures also include respective feed elements 200 shown and described in detail with regards to FIGS. 2A-2C. The feed elements 200 include, in the illustrated embodiment, a planar element characterized by longitudinal dimension (i.e., parallel to the z-axis of the coordinate system 128) and a transverse dimension (i.e., parallel to either of the x-axis or the y-axis of the coordinate system 128). Individual feed elements 200 are also composed of planar structures (e.g., a PCB) with a feed structure disposed on one side and a ground structure disposed on the other opposing side as illustrated and discussed in subsequent detail with regards to FIGS. 2A-2C. In order to facilitate radiation and/or reception of radio waves of different polarizations, the planes of the feed elements 200 are disposed perpendicular to one another as shown in FIG. 1.

In one embodiment, each feed element 200 is coupled to its own respective feed port of a communications device. In one exemplary implementation, a first feed element is connected to a first feed port having a −45° slant polarization while the second feed element is connected to a second feed port having a +45° slant polarization. Accordingly, by rotating the whole radiator structure by 45° over the ground plane the respective feed ports would be 0° and 90° polarized. As the feed elements 200 are arranged so as to have a 90° difference between them, the feed elements have good polarization isolation between the respective feed ports (i.e., good cross polarization discrimination). In alternative embodiments in which both feed elements 200 are coupled to a common feed port, the antenna apparatus 100 would exhibit good circular polarization properties by feeding each of the feed elements 200 with, for example, a 90° phase shifter of a radio frequency transceiver. The ground elements associated with respective feed elements are also coupled to a ground port of the transceiver and/or a ground plane for the radio frequency communications device. In one embodiment, one of the radiator elements (e.g., radiator elements 103, 107) of the respective pair of radiator structures is galvanically coupled to a respective feed element, while the other radiator element (e.g., radiator elements 104, 108) of the respective pair of radiator structures is galvanically coupled to a respective ground element of the respective feed elements 200.

Figure 2A:
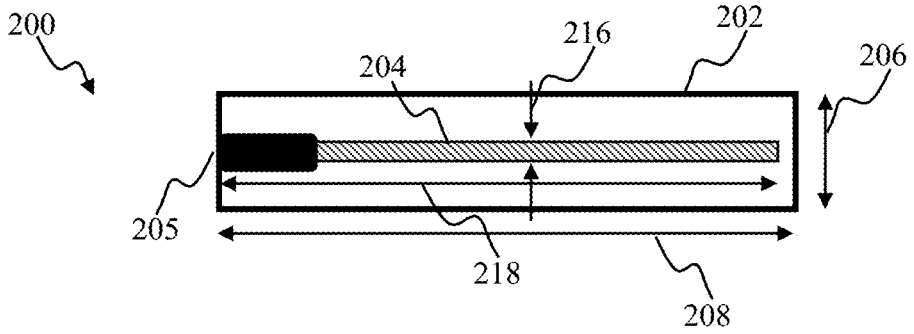
FIG. 2A is a top plan view of a planar feed element for use with the antenna apparatus of FIG. 1, in accordance with the principles of the present disclosure.
Figure 2B:
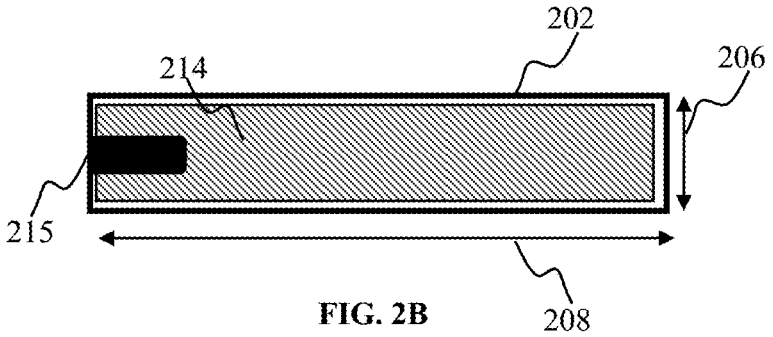
FIG. 2B is a bottom plan view of the feed element of FIG. 2A for use with the antenna apparatus of FIG. 1, in accordance with the principles of the present disclosure.
Figure 2C:
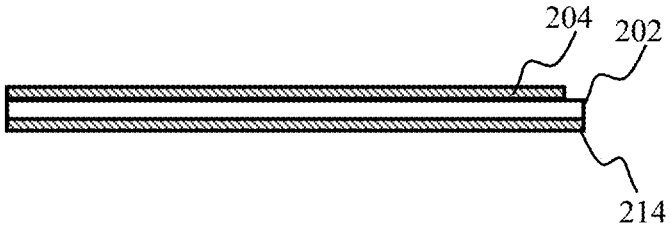
FIG. 2C is side view of the feed element of FIG. 2A for use with the antenna apparatus of FIG. 1, in accordance with the principles of the present disclosure.

FIGS. 2A-2C illustrate the planar feed element 200 for use with, for example, the antenna apparatus 100 of FIG. 1, in accordance with one implementation.

FIG. 2A is top plan view of a planar feed element 200 comprising a planar feed structure 204 disposed on top of a rectangular dielectric substrate 202. The substrate 202 may comprise any suitable dielectric material, e.g., glass reinforced epoxy (G10, G11, FR4 and/or FR5), glass, ceramic, and/or other dielectric material. Moreover, in alternative implementations, the substrate 202 may be obviated altogether with the resultant feed structure 204 and ground structure 214 being separated by an air gap. In such implementations, losses associated with the multi-element dual polarized antenna apparatus 100 are minimized. The substrate 202 may be characterized by a longitudinal dimension 208 and transverse dimension 206. In some implementations, the feed structure 204 may comprise a rectangular metallic element fabricated from, e.g., copper tape, copper deposition layer, metal strip, copper foam, and/or other conductive planar structure. The illustrated feed structure 204 is of a planar shape with a longitudinal dimension 218 that is greater than the transverse dimension 216. The feed structure 204 is configured to be galvanically connected to an antenna radiator (e.g., radiator element 107 in FIG. 1) via structure 205. The antenna element 200 also includes a planar ground structure 214 disposed on a bottom side of the dielectric substrate 202 and illustrated in detail in FIG. 2B.

FIG. 2B is bottom plan view of the planar feed element 200 of FIG. 2A. The ground structure 214 may comprise a planar rectangular conductor disposed on bottom side of the substrate 202. The ground structure 214 may comprise a rectangular metallic element fabricated from, for example, copper tape, copper deposition layer, metal strip, copper foam, and/or other conductive planar structures. The ground structure 214 is configured to be galvanically connected to an antenna radiator (e.g., radiator element 108 in FIG. 1) at structure 215. The dual polarized antenna of the present disclosure is configured to operate in one or more communication frequency bands. For example, in one implementation individual bands include a lower band (LB) covering a frequency range from 600 MHz to 960 MHz; a middle band (MB) covering a frequency range from 1710 MHz to 2170 MHz; and an upper band (UB) covering a frequency range from 2300 MHz to 2690 MHz. Alternatively, the MB and the UB may be combined into one band covering frequencies from 1710 MHz to 2790 MHz. It will be appreciated by those skilled in the arts that the antenna apparatus of the present disclosure may be configured to operate in a variety of frequency bands configured in accordance with a particular desired application. The feed elements 200 may be used to implement a dual polarized antenna (e.g., the antenna 100 shown in FIG. 1). Longitudinal dimensions (e.g., 208, 218 in FIG. 2A) of such individual elements may be configured substantially parallel (e.g., where their longitudinal axes 208, 218 are substantially parallel with one another (e.g., within an angle of 10°)); while their transverse dimensions (e.g., transverse dimension 206 in FIGS. 2A and 2B) are configured such that they are substantially perpendicular (or orthogonal) with one another.

To support antenna operation, the longitudinal dimension of antenna element (e.g., dimension 208 of the antenna element 200) is selected in accordance with a desired operating frequency. In other words, with lower frequency operation the length dimension 208 needs to be comparatively large as compared with higher frequency operation. For example, for a 2.6 GHz operating frequency, the length dimension 208 will be on the order of 25 mm. As yet another example, for a 1 GHz operating frequency, the length dimension 208 will be on the order of 80 mm. As yet another example, for a 5 GHz operating frequency, the length dimension 208 will be on the order of 10 mm. The transverse dimension of feed element (e.g., dimension 206 of the feed element 200 illustrated in FIGS. 2A and 2B) is selected in accordance with a desired impedance matching characteristic for the feed element 200. This transverse (width) dimension 206 is also affected by the thickness of the dielectric element 202 as well as the dielectric constant associated with dielectric element 202. FIG. 2C is a side view of the planar feed element of FIGS. 2A-2B for use with the antenna apparatus of FIG. 1, in accordance with one implementation. The side view in FIG. 2C details the dielectric substrate 202 with two conductors (i.e., the feed structure 204 and the ground structure 214) disposed on opposing sides of the substrate 202. In one exemplary embodiment, the impedance for feed structure 204 is selected so as to provide for a 50 Ohm impedance with the impedance being matched by the width 216 of feed structure 204 as well as the position of the ground structure 214 and the dielectric properties of the dielectric element 202. Typical thicknesses for the dielectric element 202 will range, in exemplary embodiments, from 0.4 mm to 2 mm while the dielectric constant for dielectric element 202 will range from a value selected between three (3) and ten (10). Moreover, other impedance values for the feed element 200 can be readily implemented with proper adaptation (e.g., 75 Ohm, 100 Ohm, etc.).

As previously discussed, the feed structures 204 of respective feed elements 200 are disposed such that they are facing towards another (i.e., facing the same quadrant within a three-dimensional space). Arranging the antenna feed elements using the illustrated configuration provides for a reliable antenna apparatus characterized by improved port-to-port isolation (i.e., S21, S12) and/or improved cross polarization discrimination (XPD) without the need for additional components. The antenna apparatus of the present disclosure provides, inter alia, polarization diversity by using a pair of antennas having orthogonal polarizations (e.g., horizontal/vertical, ±slant 45°, and/or left-hand/right-hand circular polarization (CP)) depending upon the specific feed port configuration as discussed previously herein. By pairing two complementary polarizations, a polarization diversity scheme may be used to reduce polarization mismatches that may otherwise cause signal fade. Additionally, such a diversity scheme may improve robustness of operation at radio and mobile communication base stations since it is less susceptible to the near random orientations of transmitting antennas of, for example, cellular devices.

In some implementations, printed circuit board (PCB) based microstrip lines may be used to construct an exemplary dual polarized antenna of the present disclosure (e.g., such as those used to obtain the performance data described with respect to FIGS. 3A-3F). However, various other antenna configurations may be realized, for example, sheet metal air suspended transmission line; metal conductors printed on a dielectric substrate (ceramic, plastic, glass, and/or other substrate materials) such as those described in U.S. patent application Ser. No. 13/782,993 entitled "Deposition Antenna Apparatus and Methods" filed Mar. 1, 2013; U.S. patent application Ser. No. 14/620,108 entitled "Methods and Apparatus for Conductive Element Deposition and Formation" filed Feb. 11, 2015; and U.S. patent application Ser. No. 14/736,040 entitled "Methods and Apparatus for Conductive Element Deposition and Formation" filed Jun. 10, 2015, the contents of each of the foregoing incorporated herein by reference in their entireties; conductors formed by using foil; flexible printed circuit board; traditional circuit board etching techniques and/or other realizations.

It is recognized that the antenna embodiments discussed herein may be readily manufactured using a variety of known methods including, for example: (1) flexible substrates; (2) sheet metal fabrication techniques; (3) fluid or vapor deposition; (4) "2-shot" molding; (5) pad printing; (6) print deposition; and/or (7) laser direct structuring (LDS), such techniques and structures being readily understood by those of ordinary skill when given the contents of the present disclosure.

Antenna Performance

FIGS. 3A-3F present data obtained during simulation and testing by the Assignee hereof of an exemplary dual-polarized antenna apparatus constructed in accordance with one or more implementations. Data presented in FIGS. 3A-3F illustrate performance of a multi-element dual polarized 2.6 GHz dipole antenna configured using various feed configurations. The antenna feed components (e.g., feed elements 200 illustrated in FIG. 1) were constructed using PCB microstrip lines.

Figure 3A:
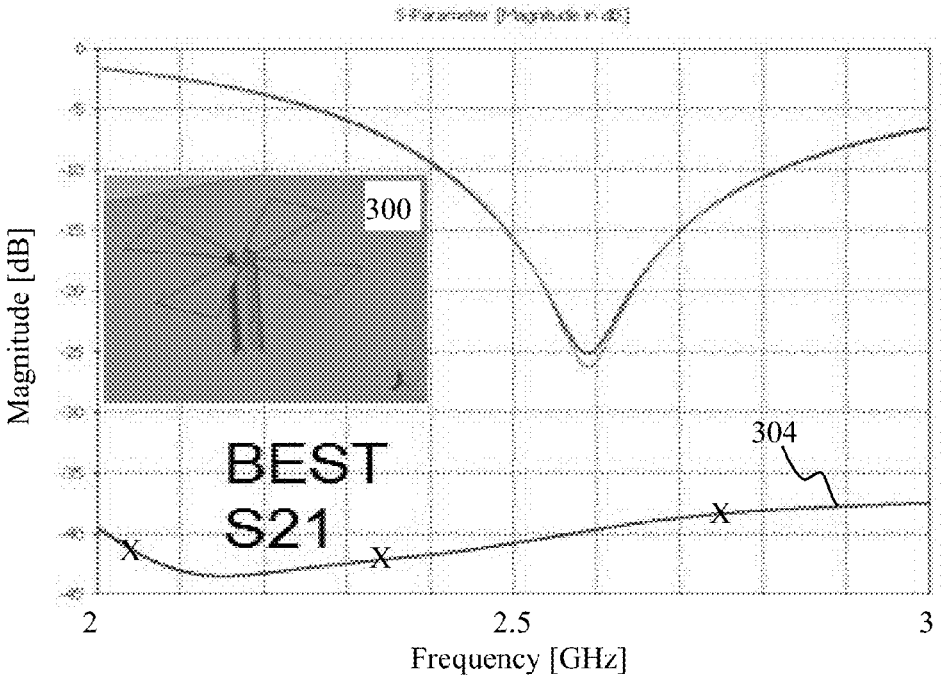
FIGS. 3A-3F are graphs illustrating performance of a multi-element dual polarized antenna for various feed configurations in accordance with the principles of the present disclosure.
Figure 3B:
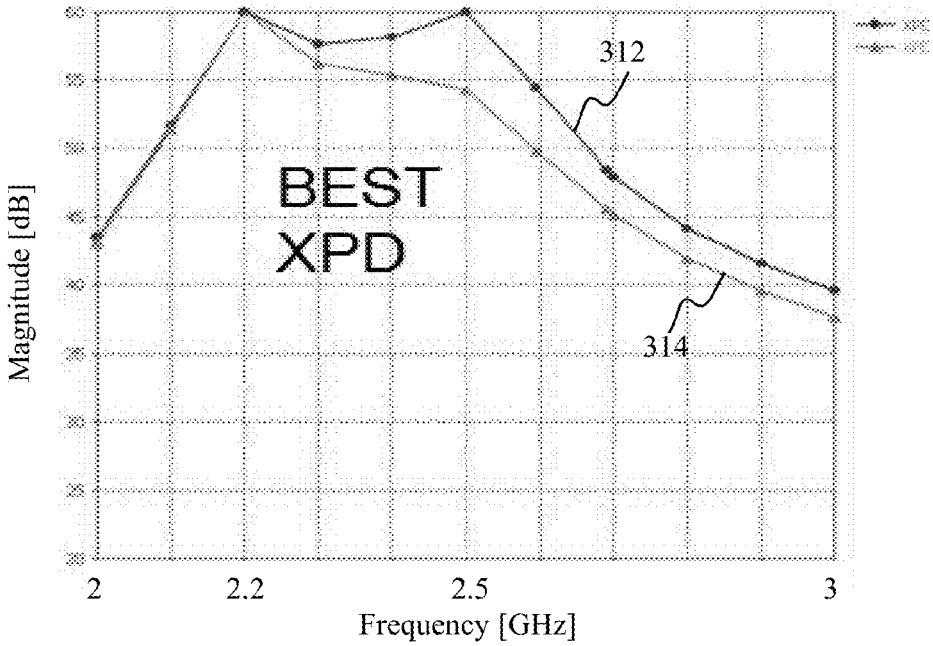
Figure 3C:
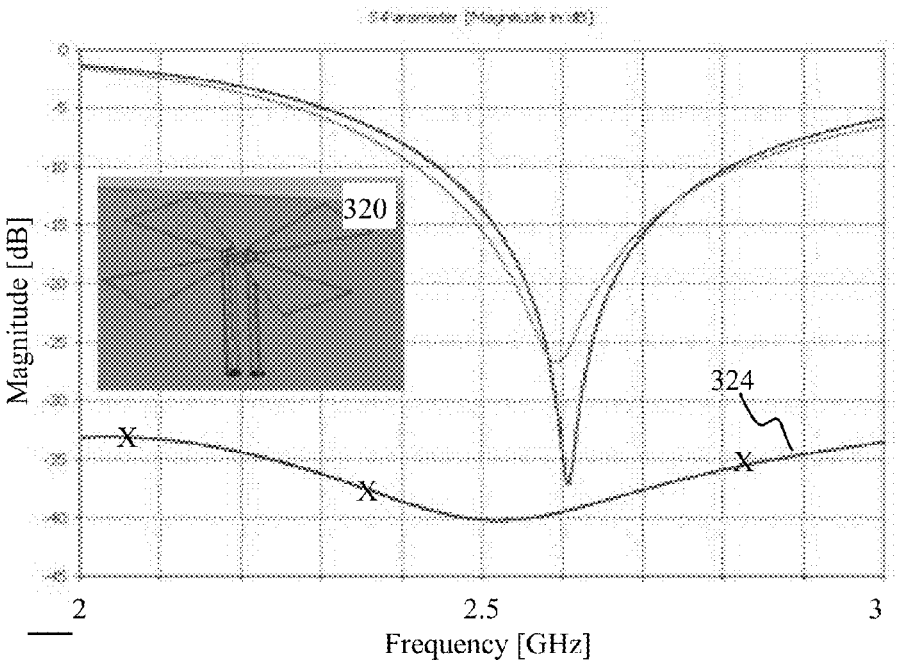
Figure 3D:
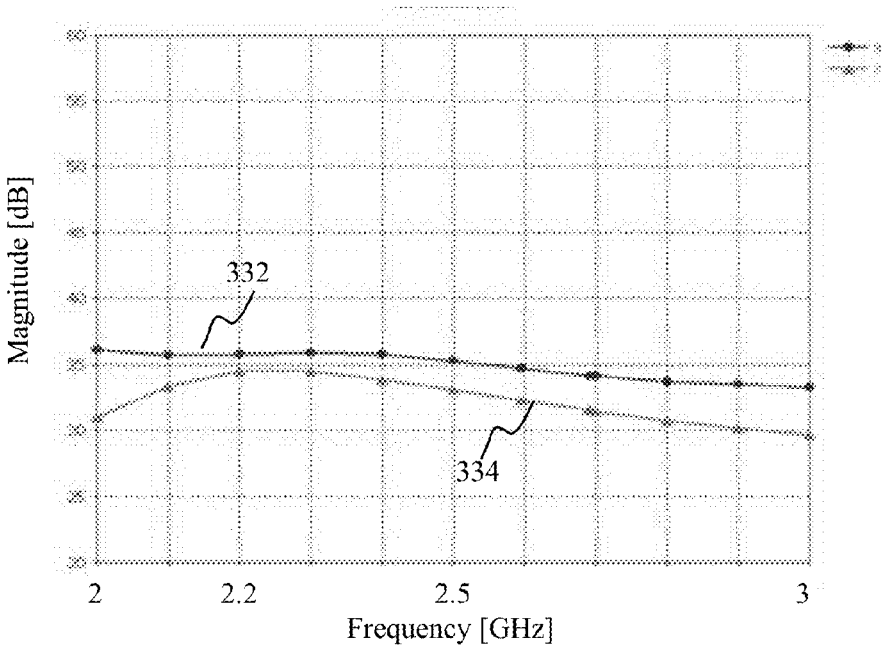
Figure 3E:
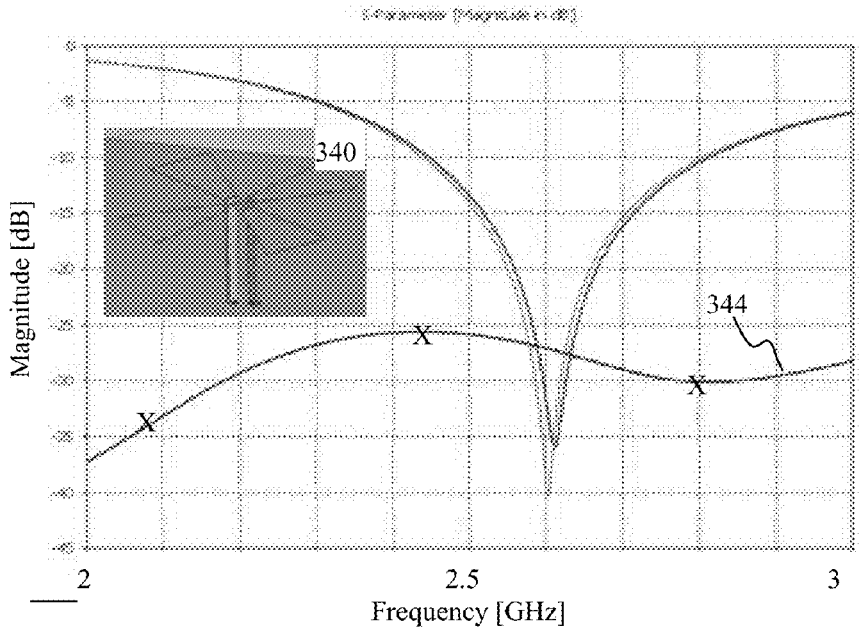

FIGS. 3A, 3C, 3E are plots of antenna port 1 to port 2 isolation S21 in dB (i.e., curves marked with symbol 'X') as a function of frequency.

Figure 3F:
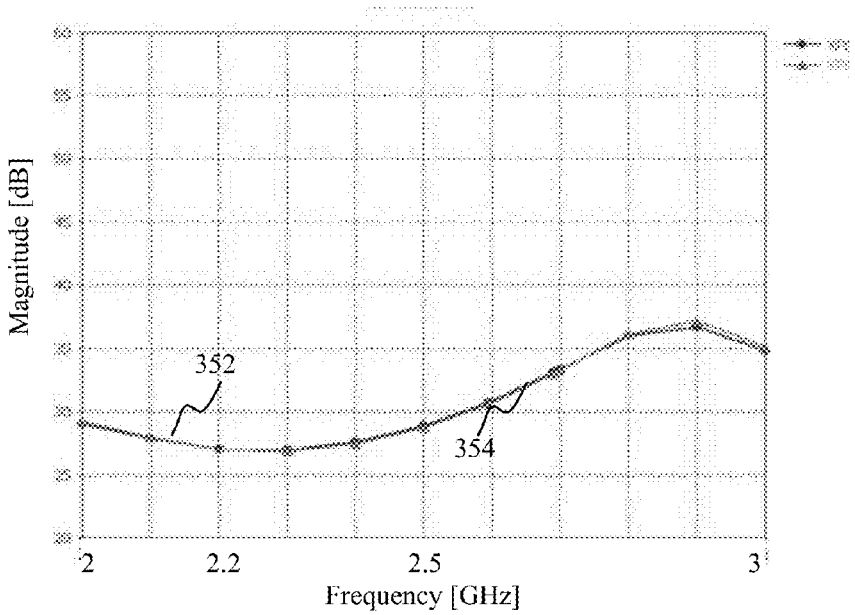

FIGS. 3B, 3D, 3F are plots of antenna cross polarization discrimination (XPD) determined at antenna boresight as a function of frequency. The term antenna boresight may be used to describe the axis of maximum gain (maximum radiated power) (e.g., x-axis of the coordinate system 128 in FIG. 1).

Data in FIGS. 3A-3B correspond to the so-called "facing feeds" antenna configuration such as that shown in FIG. 1 wherein the feed structures 204 of the two planar antenna feed elements 200 face towards the same quadrant within a three-dimensional space.

Data in FIGS. 3C-3D correspond to the so-called "feed facing ground" antenna configuration wherein a feed structure of one antenna feed element 200 is configured to face the same quadrant within a three-dimensional space as the ground element of another antenna feed element 200.

Data in FIGS. 3E-3F correspond to the so-called "facing grounds" antenna configuration wherein a grounding structure for one feed element is configured to face the same quadrant within a three-dimensional space as a ground structure of an adjacent feed element.

As used herein the terms "facing feeds", "facing grounds", and/or "feed facing ground" may be used to describe spatial orientation of two or more feed elements disposed such that their longitudinal dimensions (e.g., dimensions 208, 218 in FIG. 2A) are substantially parallel with one another; while their transverse dimensions (e.g., dimension 206 in FIGS. 2A and 2B) are substantially perpendicular/orthogonal (e.g., 80°-100°) with respect to one another. The term "facing feeds" configuration refers to the fact that the feed structures of the feed element share a given quadrant of a three-dimensional space.

Comparing XPD data shown by curves 312, 314 in FIG. 3B, curves 332, 334 in FIG. 3D, and curves 352, 354 in FIG. 3B it may be concluded that placing the antenna feed traces perpendicular/orthogonal with one another while having the feed traces facing towards the same quadrant produces an antenna apparatus characterized by an increase in port to port isolation and cross polarization discrimination, as compared to the other two antenna configurations.

Comparing port-to-port isolation data shown by curve 304 in FIG. 3A, curve 324 in FIG. 3C, and curve 344 in FIG. 3E it may be concluded that the feeds facing antenna configuration of, for example, FIG. 1 produces the greatest port-1 to port-2 isolation (by 8 dB to 15 dB) polarization discrimination, compared to the other two antenna configurations.

Methods

Figure 4:
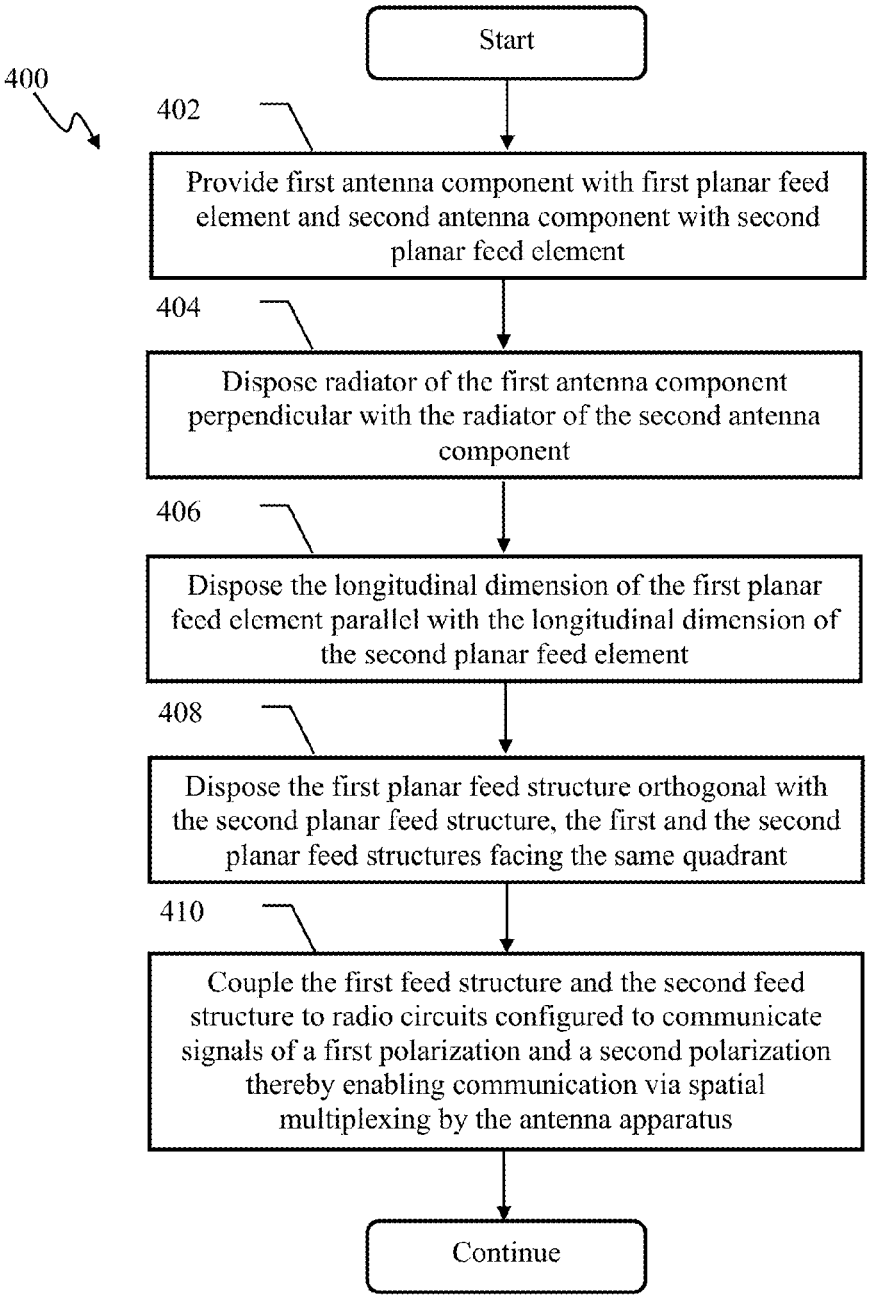
FIG. 4 is a logical flow diagram illustrating a method of configuring a multi-element dual polarized antenna apparatus for spatial multiplexing in a communications device in accordance with the principles of the present disclosure.

FIG. 4 is a logical flow diagram illustrating a method of configuring a multi-element dual polarized antenna apparatus for spatial multiplexing in a mobile communications device in accordance with one or more implementations.

At step 402, a first and a second antenna component is provided having first and second feed elements, respectively.

At step 404, the radiator of the first antenna component is disposed substantially perpendicular/orthogonal (e.g., at an angle between 80°-100°) with respect to the radiator of the second antenna component. FIG. 1 illustrates one exemplary implementation of the dual polarized antenna apparatus configuration.

At step 406, the longitudinal dimension of the first planar feed element is arranged such that it is substantially parallel (e.g., within about 10°) with the longitudinal dimension of the second planar feed element.

At step 408, the first planar feed element is disposed perpendicular/orthogonal (e.g., within about an 80°-100° angle) with the second planar feed element. Additionally, the first feed structure of the first planar feed element is disposed such that it faces the same quadrant as the second feed structure of the second planar feed element (i.e., a so-called "feeds facing" configuration).

At step 410, the first feed structure and the second feed structure are coupled to radio frequency circuits configured to communicate signals of a first polarization and a second polarization thereby enabling communication via spatial multiplexing by the antenna apparatus.

Operating Examples

Signals of the first polarization may be communicated via the radiator structure of the first antenna element (e.g., 107, 108 in FIG. 1). Signals of the second polarization may be communicated via the radiator structure of the second antenna element (e.g., 103, 104 in FIG. 1). In one exemplary implementation, the first polarization is configured perpendicular/orthogonal with the second polarization. In various implementations, the first and the second polarization may be configured at (0°, 90°), (90°, 0°), (−45°, 45°), etc. Individual signals of the first and/or the second polarization may include transmissions comprising one or more carriers encoded using a variety of transmission schemes, including for example, digital multi-carrier modulation methods such as orthogonal frequency-division multiplexing (OFDM), code division multiple access (CDMA), time division multiple access (TDMA), and/or other techniques.

Spatial multiplexing communication is provided by the antenna apparatus of FIG. 1 and is characterized by a plurality of transmit and/or receive paths (e.g., effectuated by the antenna radiator structures illustrated in FIG. 1). A communication path associated with one radiator structure is characterized by a different path length relative to the communication path associated with another radiator structure. Individual radio frequency signals propagated over individual paths may include one or more carriers of a given frequency and/or frequencies. Individual carriers of a given frequency propagated over individual spatially diverse paths are characterized by their respective time of arrival and/or phase thereby enabling carrier detection. In some polarization diversity communication implementations, communication associated with one radiator structure is characterized by radio signals of one polarization (e.g., 0°, 90°, −45°, and/or other polarization). Communications associated with another radiator structure is characterized by radio signals of another polarization (e.g., 90°, 0°, 45°, and/or other polarization). Individual radio frequency signals communicated using the structures 103, 104, 107, 108 may comprise one or more carriers of a given frequency and/or frequencies. Two carriers of a given frequency may be communicated using two distinct polarizations, e.g., (0° and 90°), (90° and 0°), (−45° and 45°) and/or other combinations, thereby enabling thereby enabling carrier detection using polarization diversity processing.

Dual polarized antenna methodology presented herein provides for a dual polarized antenna feed arrangement that is configured to optimize isolation of individual elements of the antenna from one another and improves cross polarization performance. Data obtained by the Assignee hereof confirm that feeds-facing feed configurations provide for increased port to port isolation (down to about −40 dB) and an increased cross polarization discrimination (up to about 55 dB) when compared to other feed/ground configurations. It is noteworthy that the above performance improvements (e.g., the improved port to port isolation and cross polarization discrimination) may be obtained without use of additional components and/or modification to electrical circuits. The approach of the present disclosure provides for antenna manufacturing methods capable of providing robust dual polarized antenna apparatus at reduced cost and/or increased repeatability compared to existing methods. Dual polarized antenna apparatus of the disclosure may be employed in a variety of radio frequency communication applications such as, for example, cellular base transceiver stations (e.g., LTE, Node B, evolved Node B, and/or other nodes), repeater stations, small-cell base stations, femto-cells, pico cells, micro cells, distributed antennas (DAS), and or other antenna applications.

It will be recognized that while certain aspects of the disclosure are described in terms of a specific sequence of steps of a method, these descriptions are only illustrative of the broader methods of the present disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure as discussed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A dual polarized radio frequency antenna apparatus, comprising:

a first radiator component configured to communicate radio frequency waves of a first polarization;

a second radiator component configured to communicate radio frequency waves of a second polarization;

a first feed component galvanically coupled to the first radiator component; and a second feed component galvanically coupled to the second radiator component, the first and the second feed components configured to communicate radio frequency waves of the first and the second polarization, respectively;

wherein:

the first feed component comprises a first planar conductor characterized by a longitudinal dimension and a transverse dimension;

the second feed component comprises a second planar conductor characterized by a longitudinal dimension and a transverse dimension;

the longitudinal dimension of the second feed component being arranged parallel with the longitudinal dimension of the first feed component;

the transverse dimension of the second feed component being arranged perpendicular with the transverse dimension of the first feed component;

the first planar conductor and the second planar conductor configured to face a given quadrant;

an orientation of the first polarization and an orientation of the second polarization are configured at an angle with respect to one another, the angle selected from the range between 85 and 95 degrees, inclusive;

the first radiator component is configured at the angle with respect to the second radiator component;

the first feed component comprises:

a first planar ground conductor; and a first planar dielectric substrate comprising a first planar surface configured to support the first planar conductor and a second planar surface configured to support the first planar ground conductor; and the second feed component comprises:

a second planar ground conductor; and a second planar dielectric substrate comprising a third planar surface configured to support the second planar conductor and a fourth planar surface configured to support the second planar ground conductor.

2. The antenna apparatus of claim 1, wherein the first polarization is characterized by a polarization orientation that is 90 degrees from a polarization orientation associated with the second polarization.

3. The antenna apparatus of claim 1, wherein the first and the second planar ground conductors are configured to be coupled to the first and the second radiator components, respectively.

4. The antenna apparatus of claim 1, wherein:

the first planar conductor is configured to be coupled to a first port of a radio frequency transceiver; and the second planar conductor is configured to be coupled to a second port of the radio frequency transceiver, the transceiver configured to communicate radio frequency waves of the first polarization and the second polarization waves in a frequency band.

5. The antenna apparatus of claim 4, wherein the frequency band is selected from a range between 1700 MHz and 2700 MHz.

6. The antenna apparatus of claim 4, wherein the first port comprises a first slant polarization, and the second port comprises a second slant polarization.

7. The antenna apparatus of claim 6, wherein the first and second slant polarizations are configured to correspond to a substantially orthogonal polarization with respect to each other.

8. The antenna apparatus of claim 1, wherein the first feed component and the second feed component are configured to be coupled to a common feed port.

9. The antenna apparatus of claim 1, wherein the communication of the radio frequency waves of the first polarization is configured to occur contemporaneously with communication of the radio frequency waves of the second polarization.

10. The antenna apparatus of claim 9, wherein the communication of the radio frequency waves of the first polarization and communication of the radio frequency waves of the second polarization comprise transmission via a plurality of carriers, the plurality of carriers being configured to use one or more transmission schemes.

11. The antenna apparatus of claim 9, wherein:

the communication of the radio frequency waves of the first polarization is configured to provide a first communication path; and the communication of the radio frequency waves of the second polarization is configured to provide a second communication path, the second communication path comprising a different path length relative to the first communication path.

12. The antenna apparatus of claim 11, wherein the first and the second communication paths are configured to effectuate polarized multiplexing.

13. The antenna apparatus of claim 11, wherein:

the first communication path is characterized by a first path length; and the second communication path is characterized by a second path length that is different from the first path length.

14. The antenna apparatus of claim 13, wherein:

the second communication path is configured to produce a differing signal phase as compared to a phase of signal propagating over the first communications path.

15. A component of an antenna configured to communicate radio signals of a first polarization and a second polarization, the component comprising:

a first planar feed structure configured to be coupled to a first radiator of the antenna, the first radiator configured to communicate radio signals of the first polarization; and a second planar feed structure configured to be coupled to a second radiator of the antenna, the second radiator configured to communicate radio signals of the second polarization;

wherein:

the first polarization is configured to be substantially orthogonal with the second polarization;

a plane of the first planar feed structure is configured substantially orthogonal to a plane of the second planar feed structure;

the first planar feed structure and the second planar feed structure are disposed such that they both face a given quadrant of a three dimensional space;

the first planar feed structure is characterized by a first longitudinal dimension and a first transverse dimension;

the second planar feed structure is characterized by a second longitudinal dimension and a second transverse dimension;

the second longitudinal dimension of the second planar feed structure is substantially parallel with the first longitudinal dimension of the first planar feed structure;

the second transverse dimension of the second planar feed structure is substantially orthogonal with the first transverse dimension of the first planar feed structure;

the first planar feed structure comprises a first planar dielectric substrate, a first planar ground conductor and a first planar feed conductor, the first planar ground conductor and the first planar feed conductor being disposed on opposing sides of the first planar dielectric substrate; and the second planar feed structure comprises a second planar dielectric substrate, a second planar ground conductor and a second planar feed conductor, the second planar feed conductor and the second planar ground conductor being disposed on opposing sides of the second planar dielectric substrate.

16. The component of claim 15, wherein:

the first planar dielectric substrate and the second planar dielectric substrate are disposed such that a surface of the first planar dielectric substrate that is supporting the first planar feed conductor and a surface of the second planar dielectric substrate that is supporting the second planar feed conductor are facing the given quadrant.

17. The component of claim 15, wherein the first planar feed structure and the second first planar feed structure are coupled to a common feed port.

18. The component of claim 15, wherein the second transverse dimension of the second planar feed structure is disposed at an angle of 80 to 100 degrees, inclusive, with respect to the first transverse dimension of the first planar feed structure.

19. The component of claim 15, wherein the second longitudinal dimension of the second planar feed structure is disposed with respect to the first longitudinal dimension of the first planar feed structure such that the first and second longitudinal dimensions are within 10 degrees of each other.

20. The component of claim 15, wherein:

the first and second transverse dimensions are selected to correspond to a desired operating frequency of the antenna; and the first and second longitudinal dimensions are selected to correspond to a desired impedance matching characteristic of the first and second planar feed structures, respectively.

* * * * *